US011717841B2

(12) United States Patent
Hong

(10) Patent No.: US 11,717,841 B2
(45) Date of Patent: Aug. 8, 2023

(54) LIQUID CHEMICAL SPRAYER

(71) Applicant: SMBURE CO., LTD., Gwangju (KR)

(72) Inventor: Gi Sool Hong, Gwangju (KR)

(73) Assignee: SMBURE CO., LTD., Gwangju (KR)

( * ) Notice: Subject to any disclaimer, the term of this patent is extended or adjusted under 35 U.S.C. 154(b) by 124 days.

(21) Appl. No.: 17/483,578

(22) Filed: Sep. 23, 2021

(65) Prior Publication Data

US 2023/0019040 A1 Jan. 19, 2023

(30) Foreign Application Priority Data

Jul. 16, 2021 (KR) ..... 10-2021-0093717

(51) Int. Cl.

| | |
|---|---|
| ***B05B 7/10*** | (2006.01) |
| ***B05B 7/24*** | (2006.01) |
| ***B05B 1/30*** | (2006.01) |
| ***B05B 7/12*** | (2006.01) |

(52) U.S. Cl.

CPC ..... *B05B 7/2416* (2013.01); *B05B 1/30* (2013.01); *B05B 7/10* (2013.01); *B05B 7/12* (2013.01)

(58) Field of Classification Search

CPC ..... B05B 7/2416; B05B 1/30; B05B 7/10; B05B 7/12; B05B 7/0081; B05B 1/3073; B05B 7/2464; B05B 7/2435; B05B 1/3066; B05B 7/0075; B05B 1/10; B05B 1/12; B05B 1/3405; A01M 7/005; A61L 2/26

See application file for complete search history.

(56) References Cited

U.S. PATENT DOCUMENTS

| | | | | |
|---|---|---|---|---|
| 10,342,934 | B2 * | 7/2019 | Hong | B05B 1/3073 |
| 2018/0071757 | A1 * | 3/2018 | Bennani | B05B 7/0408 |

FOREIGN PATENT DOCUMENTS

| | | |
|---|---|---|
| KR | 10-1692347 B1 | 1/2017 |
| KR | 10-2215252 B1 | 2/2021 |

* cited by examiner

*Primary Examiner* — Qingzhang Zhou

(57) ABSTRACT

The present invention relates to a liquid chemical sprayer includes: a nozzle cap which is rotatably assembled and installed in place at a rotation guide of a body; a nozzle head; a nozzle is formed at a front end of a nozzle pipe formed extending a predetermined length toward the front, and a guide plate is formed protruding to be assembled to a guide rail formed at a neck capable of operating forward and backward; a valve body formed in a cylindrical shape; a valve housing formed in a cylindrical structure fixedly installed at a rear of the nozzle head and forming a valve seat at an inner portion; and a motor housing faced and assembled with the rear of the valve housing so that the rear thereof is maintained in a fixed state, in which an air blowing module is installed.

6 Claims, 10 Drawing Sheets

[Fig.1]
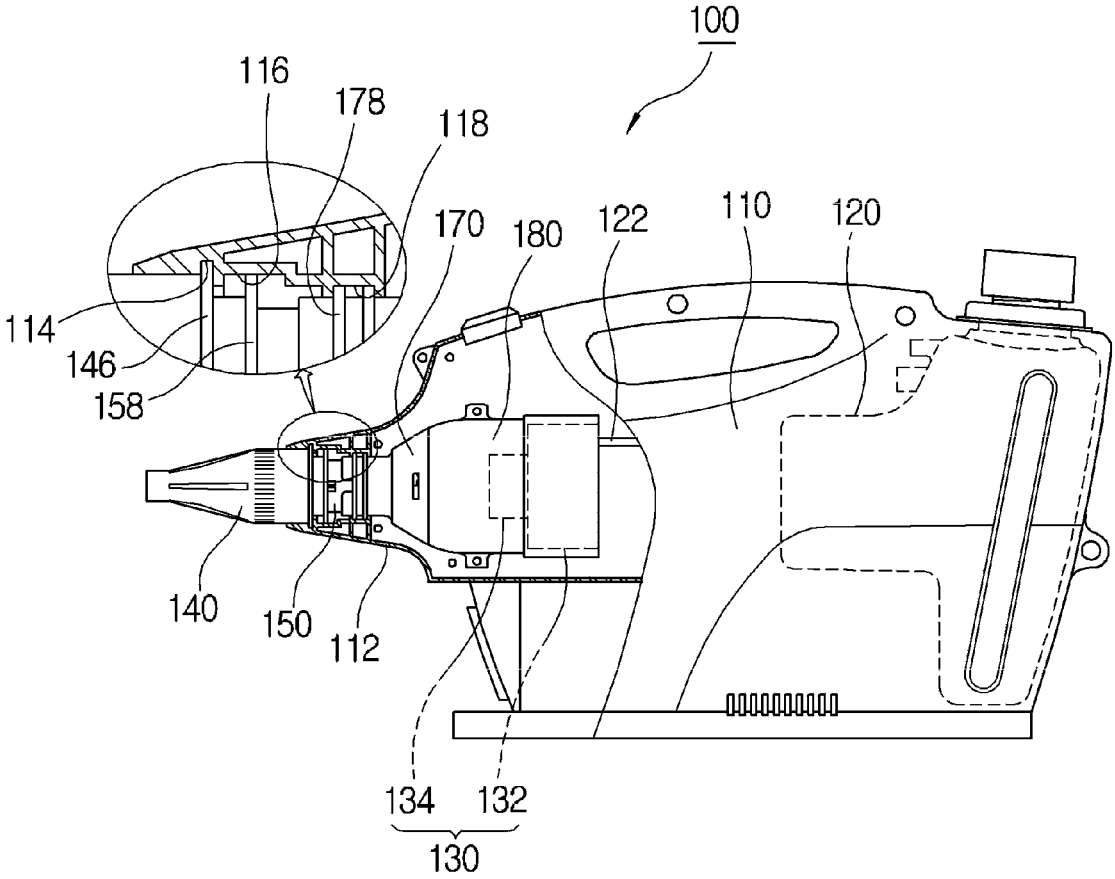

[Fig.2]
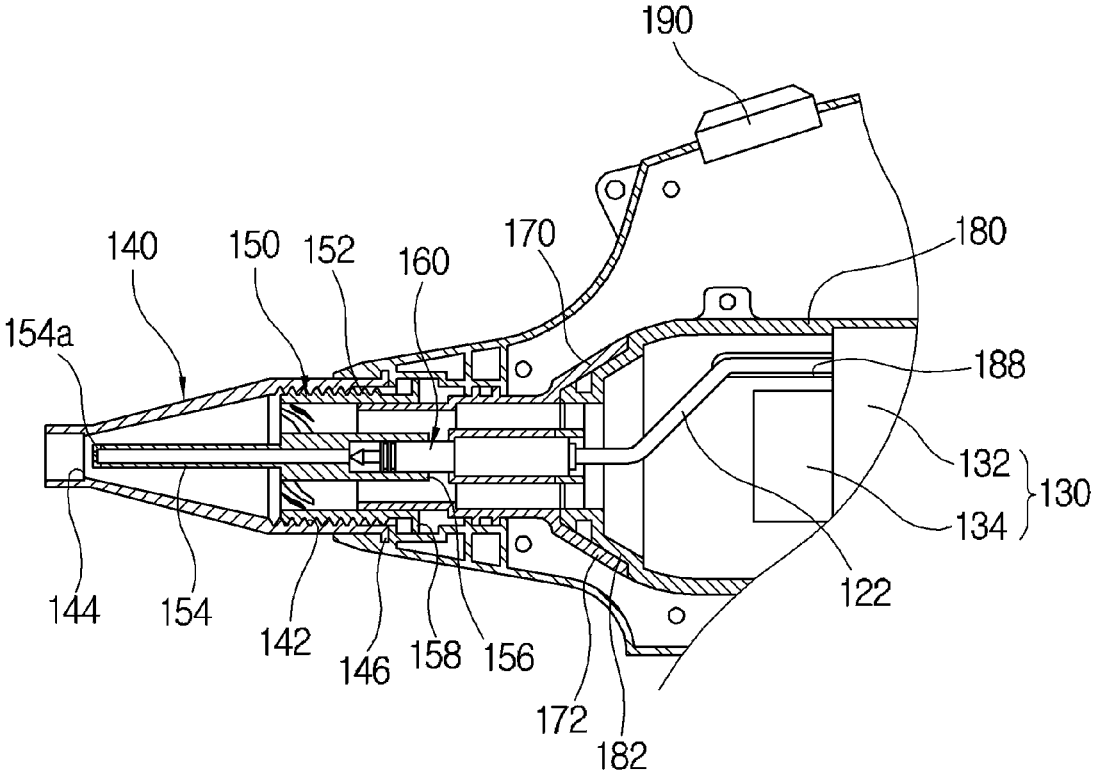

[Fig.3]
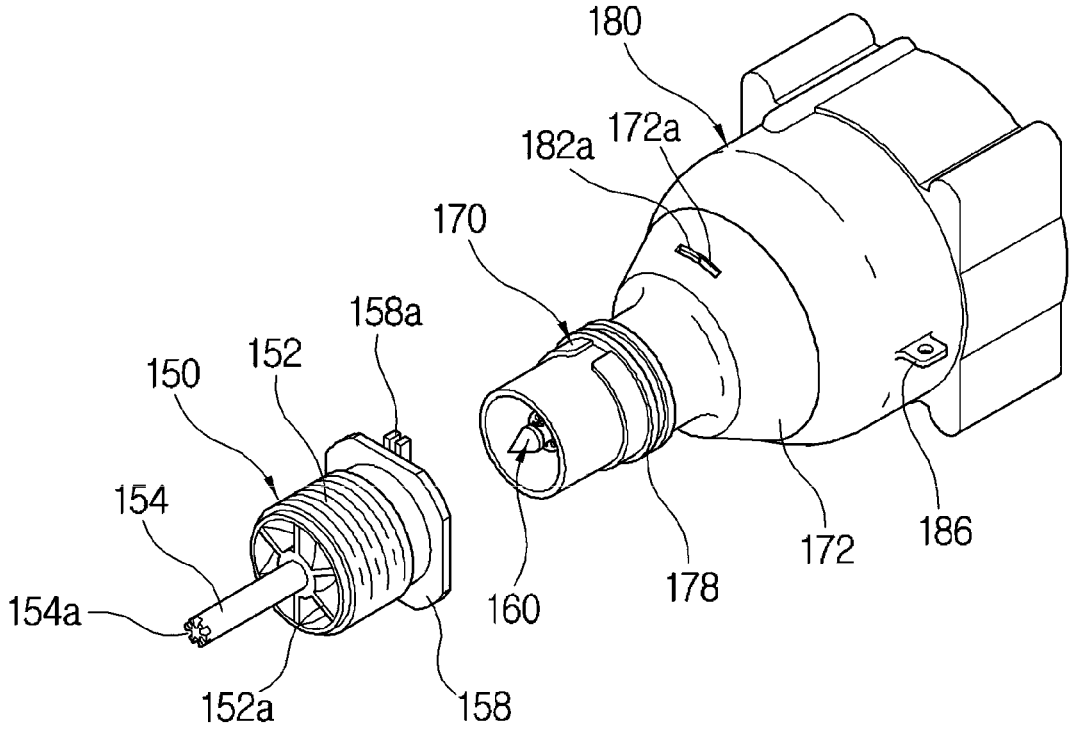

[Fig.4]
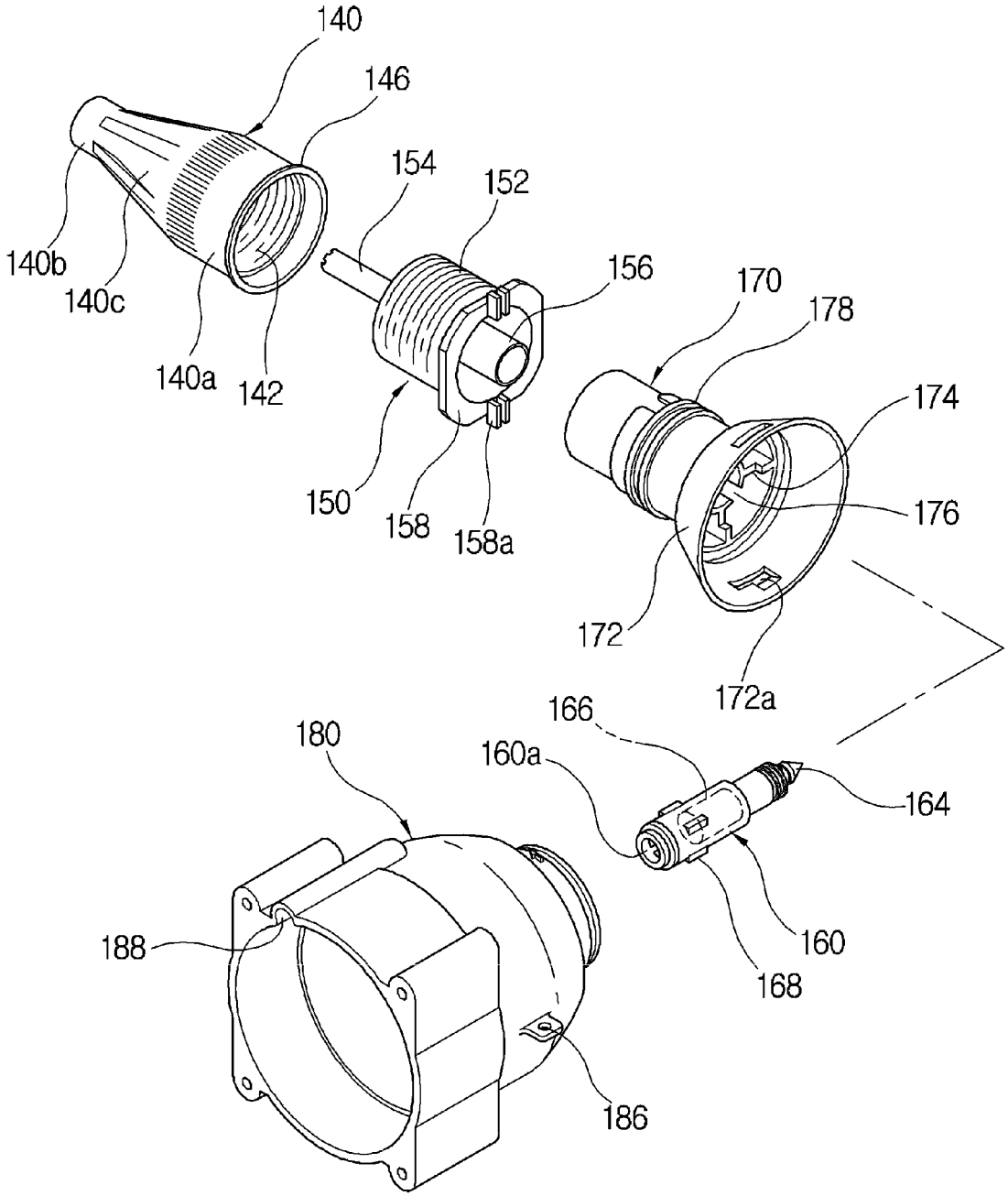

[Fig.5]
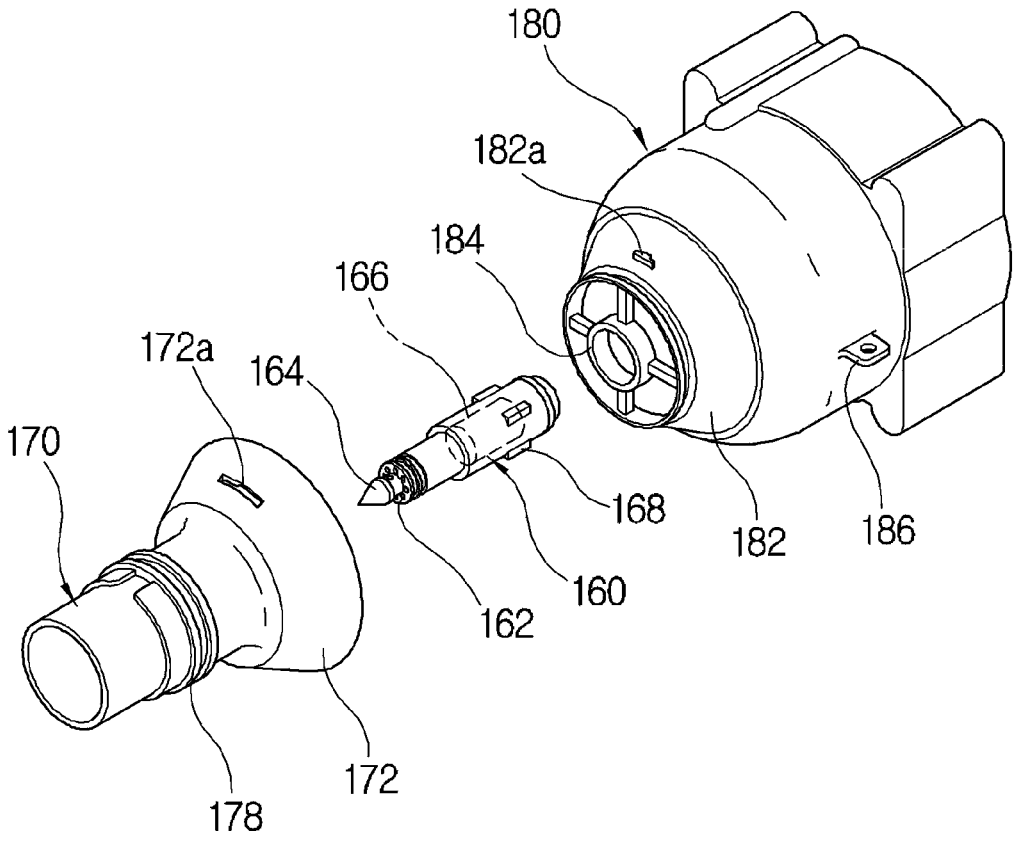

[Fig.6]
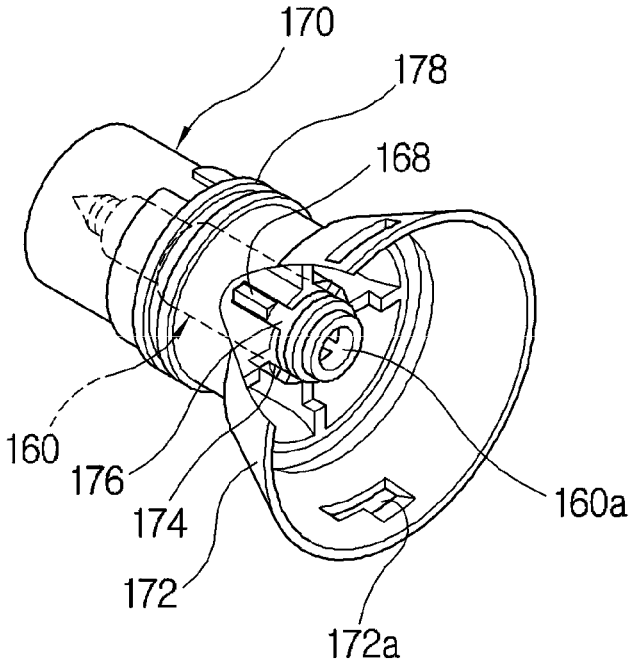

[Fig.7]
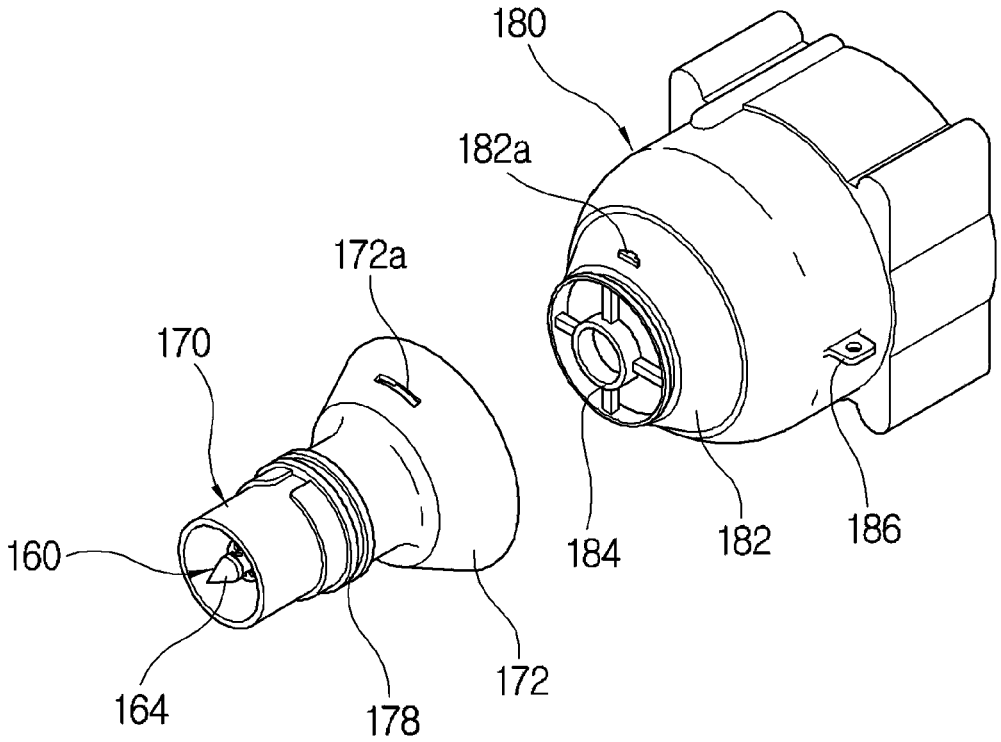

[Fig.8]
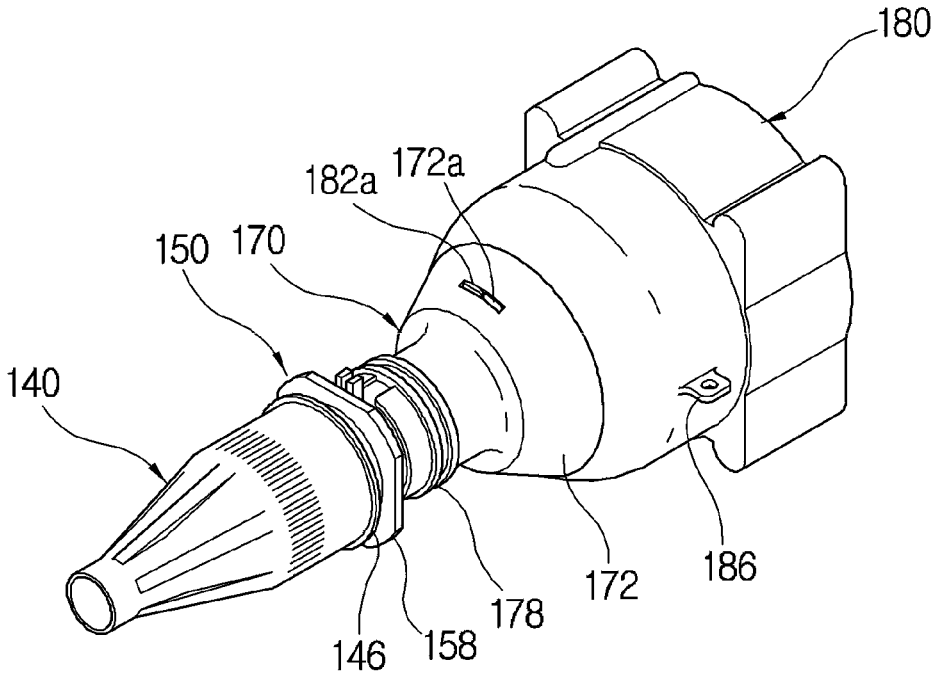

[Fig.9]
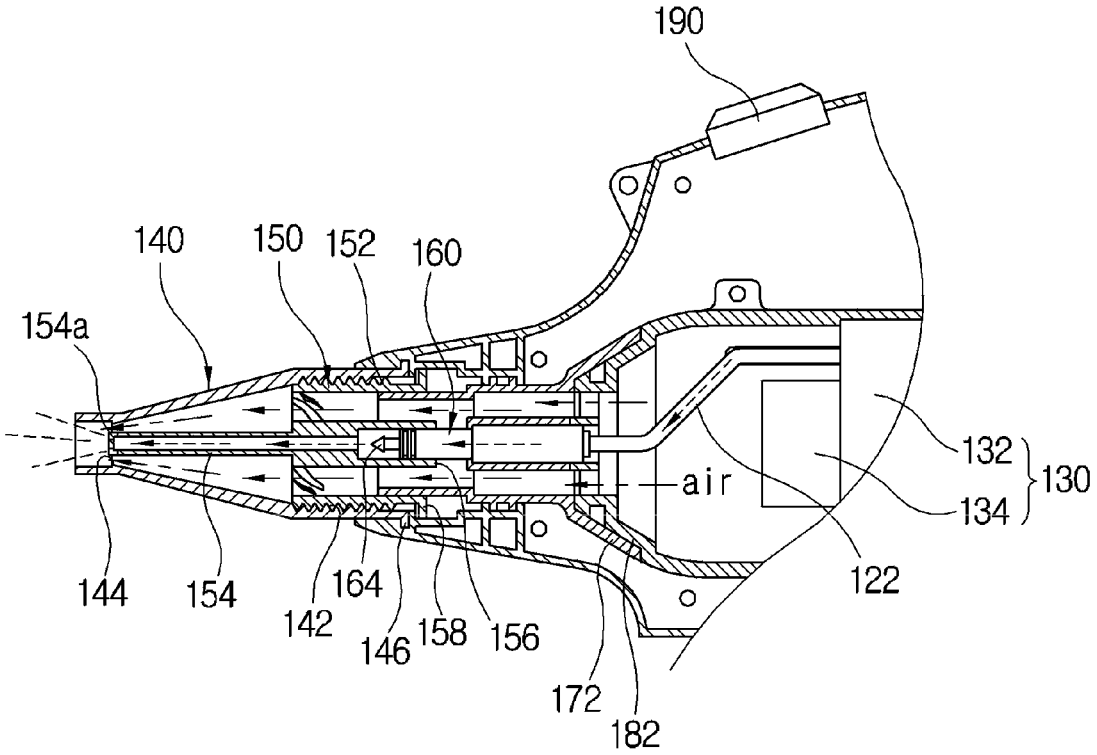

[Fig.10]
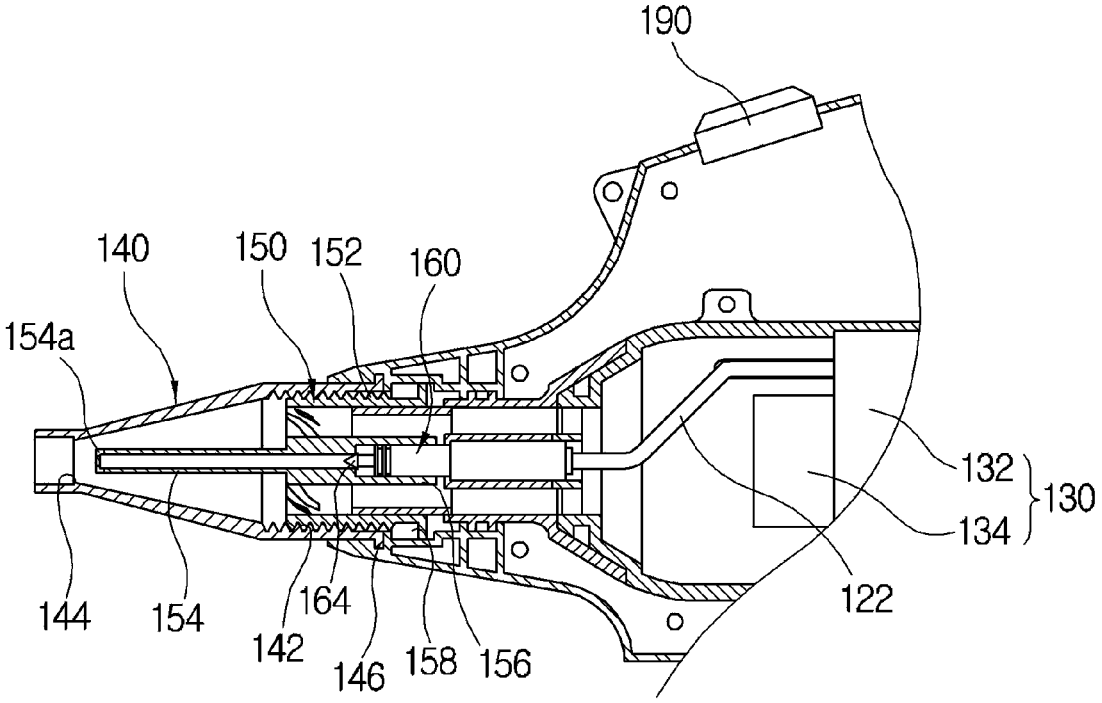

LIQUID CHEMICAL SPRAYER

TECHNICAL FIELD

The present invention relates to a liquid chemical sprayer, and more particularly, to a liquid chemical sprayer by which an amount, direction of ejection or the like of liquid chemical may be not only easily adjusted but also when ejection of liquid chemical is paused or terminated, blocking of supplied liquid chemical may be made quickly and clearly.

DISCUSSION OF RELATED ART

A sprayer for ejecting or spraying liquid chemicals such as insecticides, fungicides, and disinfectants into an air may be classified in a very diverse way depending on usage, ejecting method, and the like.

The sprayer disclosed in Patent Publication No. 10-1692347 of the Republic of Korea Patent Office (Sprayer and spray control apparatus) and No. 10-2215252 (Air pressurized sprayer having hetrogenious valves) was configured such that liquid chemical is pumped and sprayed by difference in atmospheric pressure generated inside a nozzle while an air pressurized by an air blowing fan installed at an inner side of a housing passes through a nozzle cap whose cross-sectional area is rapidly reduced.

The sprayer according to Korean Patent Publication No. 10-1692347 was configured such that a user may rotate a nozzle cap provided in front of a housing so that an amount and direction of spraying may be adjusted, and the sprayer according to No. 10-2215252 was developed so that when a user rotates a nozzle cap to a predetermined location, a flow path is blocked and a liquid chemical spraying may be blocked.

As described above, the applicant is made effort to develop a sprayer that a user can use easily and conveniently. From such a point of view, the applicant intends to develop an improved sprayer technology, which is convenient to use, and has excellent mechanical properties.

RELATED ART DOCUMENT

[Patent Document]

(Patent Document 0001) Korean Patent Publication No. 10-1692347 (2017.01.03)

(Patent Document 0002) Korean Patent Publication No. 10-2215252 (2021.02.15)

SUMMARY OF DISCLOSURE

Technical Problem

In order to solve above-described problems, an aspect of the present invention provides a liquid chemical sprayer by which an amount, direction of ejection or the like of liquid chemical may be not only easily adjusted but also when ejection of liquid chemical is paused or terminated, blocking of supplied liquid chemical may be made quickly and clearly.

Technical Solution

A liquid chemical sprayer according to one embodiment of the present invention in order to achieve the above object may include: in a sprayer provided with a liquid chemical container at one side of the rear while a neck having a reduced cross-sectional area is formed at the front of a main body toward the front and configured to spray liquid chemical in a chemical container by inducing an air pressure difference in an inner side of the neck by the air applied from an air blowing module composed of an electric motor and an air blowing fan, a nozzle cap having a cylindrical structure, in which an internal cross-sectional area is reduced as toward the front and a minimum diameter portion is formed at an inner side of the front, and in which a female screw part is formed at a predetermined portion having the same inner diameter, and assembled to an annular rotation guide formed at the neck to form an annular protrusion at an outer side of a rear end portion capable of being in-place rotation with respect to the neck; a nozzle head, in which a male screw part corresponding to the female screw part formed at the nozzle cap is formed, a nozzle is formed at a front end of a nozzle pipe formed extending a predetermined length toward the front, and a guide plate is formed protruding to be assembled to a guide rail formed at the neck capable of operating forward and backward with respect to the neck; a valve body formed in a cylindrical shape, in which a liquid chemical supply hose is connected to a rear end and a check valve is installed therein, in which a plunger for selectively opening and closing the nozzle pipe is formed in the front thereof; a valve housing formed in a cylindrical structure fixedly installed at a rear of the nozzle head and forming a valve seat at an inner portion in which the valve body is stably installed; and a motor housing faced and assembled with the rear of the valve housing so that the rear of the valve body is maintained in a fixed state, in which the air blowing module is installed.

In the liquid chemical sprayer according to one embodiment of the present invention, a flange surrounding a predetermined portion in the front of the motor housing may be formed at a predetermined portion at the rear of the valve housing, and an engaging hole corresponding to a locker protruding from a motor housing may be formed in the flange.

In the liquid chemical sprayer according to one embodiment of the present invention, an engaging protrusion may be formed to protrude at a predetermined interval on an outer circumferential surface of the valve body, and slot corresponding to the engaging protrusion may be formed at a predetermined interval on the valve seat.

In the liquid chemical sprayer according to one embodiment of the present invention, the nozzle head may be formed in a shape of six pinwheels so that ribs are formed at a predetermined angular interval and the nozzle pipe is located in a center, and the ribs are swirled in an air flowing from the rear toward the front.

In the liquid chemical sprayer according to one embodiment of the present invention, a hose pocket through which the liquid chemical supply hose is disposed may be formed at one side of an inner portion of the motor housing.

Advantageous Effects

A liquid chemical sprayer according to the present invention, when a user desires to block liquid chemical ejection by turning off a switch or rotating a nozzle cap in a close direction thereof so that spraying operation is paused or terminated while the liquid chemical is sprayed, an inlet of a nozzle pipe is blocked accurately and quickly by a plunger, and thus there is an effect that a quick pause or termination is possible.

Further, a check valve is installed at an inner portion of a valve body, when a user rotates a nozzle cap in a closing direction, and thus it has an effect that a liquid chemical supply can not only be quickly blocked but also a reverse flow of the liquid chemical can be effectively prevented.

In particular, the liquid chemical sprayer according to the present invention is primarily ejected through a liquid chemical discharge hole provided in a valve body, is secondarily ejected through a nozzle hole provided in a nozzle cap, and then is sprayed in a particulate state by strong air passing through an inside of the nozzle cap, and thus it has an effect that a spraying can be made in a ultra-fine particulate state.

DESCRIPTION OF DRAWINGS

FIG. 1 is a cross-sectional view illustrating a part of a sprayer to which a liquid chemical sprayer according to one embodiment of the present invention is applied.

FIG. 2 is a cross-sectional view of a main part of a liquid chemical sprayer according to one embodiment of the present invention.

FIGS. 3 and 4 are exploded perspective views for describing main components of a liquid chemical sprayer according to one embodiment of the present invention.

FIGS. 5 to 8 are views for describing a process in which a valve body according to one embodiment of the present invention is assembled.

FIGS. 9 and 10 are views for describing an operating state of a liquid chemical sprayer according to one embodiment of the present invention.

DETAILED DESCRIPTION OF EXEMPLARY EMBODIMENTS

Hereinafter, configurations of a liquid chemical sprayer according to one embodiment of the present invention will be described in detail with reference to the accompanying drawings.

Reference numeral 100 described in the drawings indicates a sprayer according to one embodiment of the present invention.

In a sprayer 100 according to one embodiment of the present invention, as shown in FIG. 1, a shape of a neck 112 in which an internal cross-sectional area is gradually decreased is formed at a front side of a main body 110, and a liquid chemical container 120 is installed at the rear of an inner portion of the main body 110.

In the liquid chemical sprayer according to one embodiment of the present invention, a method, in which the liquid chemical stored in the liquid chemical container 120 is pumped and ejected by a pressure difference generated outside and inside a nozzle in a process of rapidly and strongly passing air around the nozzle, is applied. As described above, an air blowing module 130 for forcibly blowing a strong wind toward a circumference of the nozzle in order to generate a large difference in air pressure is installed at the rear of the neck 112. The air blowing module 130 may include an electric motor 132 and an air blowing fan 134.

The the above-described neck 112 of the main body 110 is configured to have a structure in which a cross-sectional area decreases as toward the front as shown in the drawing. A rotation guide 114 capable of operating a rotation of a nozzle cap 140 to be installed later is formed in an annular shape at an inner side of the neck 112, and a guide rail 116 for guiding forward and backward operations of a nozzle head 150 to be installed later is formed. An annular assembly groove 118 formed in the rear of the guide rail 116 in a predetermined width is for stably assembling a valve housing 170 to be installed later while a center thereof is maintaining.

The nozzle cap 140 has a structure in which an internal cross-sectional area decreases as toward the front in order to smoothly generate a pressure difference due to an air blown by an operation of the air blowing module 130.

As shown in FIG. 2, the nozzle cap 140 has a cylindrical structure in which a large-diameter portion 140*a* and a small-diameter portion 140*b* are distinguished by a difference in diameter, and is formed between the large-diameter portion 140*a* and the small-diameter portion 140*b*, and at a predetermined portion, an inclined portion 140*c* whose inner diameter gradually decreases from the large-diameter portion toward the small-diameter portion is formed. A female screw part 142 is formed at a predetermined portion at an inner side of the large-diameter portion 140*a* of the nozzle cap 140, and a minimum diameter portion 144 is formed at an inner side of the small-diameter portion 140*b*.

In particular, an annular protrusion 146 on an end portion of the rear of the nozzle cap 140 assembled to the annular rotation guide 114 formed at the main body 110 is formed protruding outwardly, so that when a user rotates the nozzle cap 140, rotation operation is possible in place.

The nozzle head 150 according to one embodiment of the present invention is configured to operate forward or backward depending on a direction in which the nozzle cap 140 is rotated. A male screw part 152 corresponding to the female screw part 142 formed at the nozzle cap 140 is formed at a predetermined portion, and a nozzle pipe 154 protruding long at a predetermined length toward the front is formed on a central axis. A plurality of nozzle holes 154*a* are formed at a predetermined interval so that liquid chemical passing therein may be ejected at the front end of the nozzle pipe 154.

In addition, as shown in the drawings, a valve hole 156 having a relatively large diameter as compared with that of the nozzle pipe 154 at the rear of the nozzle pipe 154 is formed in a predetermined portion.

Further, a guide plate 158, which is located at the guide rail 116 formed at the main body 110 and guides linear movement, is formed protruding at the rear of the nozzle head 150 in a square shape. Furthermore, an anti-rotation protrusion 158*a* is formed in a predetermined size in upper and lower portions of the guide plate 158.

As shown in FIG. 3, the nozzle head 150 has ribs 150*a* formed at a predetermined angular interval so that the nozzle pipe 154 is disposed at a center. The ribs 150*a* may be formed in a pinwheel shape so that swirl is induced in an air flowing from the rear toward the front. It is preferable that the ribs 150*a* are formed in six each at an interval of 60 degrees.

A valve body 160 according to one embodiment of the present invention is for selectively blocking or allowing liquid chemical to pass through the nozzle pipe 154. For this, the valve body 160 is formed as a hollow therein in a cylindrical shape, and a liquid chemical discharge hole 162 through which liquid chemical passes is formed at a predetermined interval in the front, and at a location spaced apart from the liquid chemical discharge hole 162 at a predetermined distance, a plunger 164 is formed protruding from the front end, and a check valve 166 is installed therein.

The described-above plunger 164 is formed in a conical shape, may be detachably attached to a front end of the valve body 160, and is molded of a rubber material to correspond to an inlet of the nozzle pipe 154 to have good airtightness.

A hose connector 160*a* to which a liquid chemical supply hose 122 capable of being connected is formed at the rear of the valve body 160. In addition, an engaging protrusion 168 is formed in a protruding structure at a predetermined angular interval in an outer circumferential surface of the valve body 160.

Meanwhile, in the liquid chemical sprayer according to one embodiment of the present invention, the valve housing 170 which allows the valve body 160 assembled by fitting the front end into the valve hole 156 to be stably assembled and installed in the main body 110, is integrally coupled to the front of a motor housing 180 as shown in FIG. 3.

The valve housing 170 is formed in a cylindrical structure having a predetermined length as shown in FIGS. 4 to 7, and a flange 172 surrounding a predetermined portion in the front of the motor housing 180 is formed in the rear thereof. An engaging hole 172*a* corresponding to the locker 182*a* formed protruding from the motor housing 180 is formed in the flange 172.

The above-described locker 182*a* is rotated at a predetermined angle in a state in which the engaging hole 172*a* is fitted so that the valve housing 170 and the motor housing 180 are integrally coupled.

A valve seat 174 in which the valve body 160 may be stably installed is formed in the valve housing 170, and a slot 176 are formed on the valve seat 174 at a predetermined angular interval. The slot 176 is formed in a location and size corresponding to the engaging protrusion 168 of the valve body 160 so that the engaging protrusion 168 formed at an outer circumferential surface of the valve body 160 may be fitted.

An annular assembly protrusion 178 formed protruding to correspond to the assembly groove 118 formed in an annular shape at an inner side of the neck 112 around a middle portion of the valve housing 170 is formed.

In addition, a flange seat 182 corresponding to the flange 172 of the valve housing 170 is formed so that the valve housing 170 may be faced and assembled at the front of the motor housing 180 in which the air blowing module 130 is assembled and installed therein. As shown in the drawings, a locker 182*a* corresponding to the engaging hole 172*a* is formed protruding on the flange seat 182.

When the valve housing 170 and the motor housing 180 are faced and coupled to each other in a state in which the valve body 170 is assembled to the valve housing 170 in the front of the motor housing 180, a stopper 184 is formed so that a rear end of the valve body 160 may be in a close contact with each other stably. The stopper 184 is formed in a structure to which the ribs is disposed at a regular angular interval is connected.

A fixer 186 for fixing and installing are formed at an inner portion of the main body 110 at both side surfaces of the motor housing 180.

The electric motor 132 and the air blowing fan 134 are fixed and mounted to the rear of an inner portion of the motor housing 180. A hose pocket 188 for stably disposing the liquid chemical supply hose 122 is formed at one side of an inner portion of the motor housing 180.

In a state in which the above-described valve body 160 is first assembled to the valve housing 170 as shown in FIG. 6, the valve housing 170 and the motor housing 180 are coupled to each other as shown in FIG. 7.

In addition, in a state in which the nozzle cap 140 and the nozzle head 150 are coupled to each other, the valve housing 170 is assembled from a rear side of the nozzle head 150 as shown in FIG. 8. As described above, in a state in which the nozzle cap 140, the nozzle head 150, the valve housing 170, the valve body 160, and the motor housing 180 are sequentially coupled as a single assembly, the single assembly is assembled to the neck 112 of the body 110 as shown in FIG. 2.

Hereinafter, a state in which the liquid chemical sprayer according to one embodiment of the present invention is operated will be briefly described with reference to the accompanying FIGS. 9 and 10.

In a state in which a switch 190 of the liquid chemical sprayer according to one embodiment of the present invention is On, FIG. 9 is a view illustrating a state in which as a user rotates the nozzle cap 140 to a maximum in a forward direction, a front end of the nozzle pipe 154 of the nozzle head 150 and the minimum diameter portion 144 formed at an inner portion of the nozzle cap 140 are closest to each other.

When the switch 190 of the liquid chemical sprayer is On, an air blown from the air blowing fan 134 passes through quickly and strongly in the motor housing 180, the valve housing 170, the nozzle head 150 and the nozzle cap 140 by the air blowing module 130. In particular, as an internal cross-sectional area of the nozzle cap 140 is rapidly reduced, an air pressure difference between inside and outside the nozzle pipe 154 is generated, and such a pressure difference is transferred to the liquid chemical container 120 via the liquid chemical supply hose 122, so that the liquid chemical is pumped. As described above, when the pumped liquid chemical is transferred to the valve body 160 along the liquid chemical supply hose 122, and while the liquid chemical passes through the check valve 166 of the valve body 160 and is discharged to the liquid chemical discharge hole 162, a primary spraying is made.

At this point, since the plunger 164 is an opened state spaced apart from an inlet of the nozzle pipe 154 at a predetermined distance, the liquid chemical primarily ejected via the liquid chemical discharge hole 162 of the valve body 160 passes through the nozzle pipe 154 of the nozzle head 150, and then a spraying is secondarily made via the nozzle hole 154*a* formed at the front end.

As described above, the liquid chemical may be primarily ejected into the nozzle pipe 154 via the liquid chemical discharge hole 162 of the valve body 160, and the liquid chemical which has passed through the nozzle pipe 154 may be secondarily ejected via the nozzle hole 154*a*, and a spraying may be made by a strong air passing through the inside of the nozzle cap 140 in a particulate state.

In a state in which the switch 190 of the liquid chemical sprayer according to one embodiment of the present invention is OFF, FIG. 10 is a view illustrating a state in which as a user rotates the nozzle cap 140 to a maximum in a backward direction, an inlet of the nozzle pipe 154 of the nozzle head 150 is blocked by a close contact with the plunger 164 provided at a front end of the valve body 160.

As described above, as the inlet of the nozzle pipe 154 is blocked, a flow of the liquid chemical flowing along the liquid chemical supply hose 122 is rapidly blocked, so that even when there is a pressure difference remaining inside the nozzle cap 140 and the nozzle head 150, blocking of the liquid chemical ejected into the nozzle hole 154*a* is made quickly.

In addition, since the check valve 166 is installed inside the valve body 160, a phenomenon in which the liquid chemical flows back into the liquid chemical container via the liquid chemical supply hose 122 is also prevented simultaneously. Accordingly, when a user operates the sprayer again, a spraying can be sprayed more quickly.

A liquid chemical sprayer according to one embodiment of the present invention, when a user desires to block liquid chemical ejection by turning off a switch or rotating the nozzle cap 140 in a closing direction so that the spraying operation is paused or terminate while the liquid chemical is ejected, an inlet of the nozzle pipe 154 is stably blocked by the plunger 164 of the valve body 160, and thus there is an effect that a quick stop is possible.

Further, as the check valve 166 is installed inside the valve body 160, when a user rotates the nozzle cap 140 in a closing direction, there is an advantage in that not only rapid blocking but also backflow of the liquid chemical can be effectively prevented.

The above has been described in detail with respect to a configuration and operating state of the liquid chemical sprayer according to one embodiment of the present invention. Such embodiments are included in technical spirits described in the claims of the present invention. In addition, such embodiments are merely exemplary, and should not be construed as limited in interpreting claims of the present invention.

DESCRIPTION OF REFERENCE NUMERALS

100: Sprayer
110: Main body
112: Neck
120: Liquid chemical container
122: Liquid chemical supply hose
130: Air blowing module
132: Electric motor
134: Air blowing fan
140: Nozzle cap
142: Female screw part
150: Nozzle head
152: Male screw part
154: Nozzle pipe
156: Valve hole
158: guide plate
160: Valve body
162: Liquid chemical discharge hole
164: Plunger
166: Check valve
168: Engaging protrusion
170: Valve housing
172: Flange
174: Valve seat
176: Slot
180: Motor housing
182: Flange seat
190: Switch

The invention claimed is:

1. A liquid chemical sprayer, comprising:

in a sprayer provided with a liquid chemical container at one side of the rear while a neck having a reduced cross-sectional area is formed at the front of a main body toward the front and configured to spray liquid chemical in a chemical container by inducing an air pressure difference in an inner side of the neck by the air applied from an air blowing module composed of an electric motor and an air blowing fan, a nozzle cap having a cylindrical structure, in which an internal cross-sectional area is reduced as toward the front and a minimum diameter portion is formed at an inner side of the front, and in which a female screw part is formed at a predetermined portion having a same inner diameter, and assembled to an annular rotation guide formed at the neck to form an annular protrusion at an outer side of a rear end portion capable of being in-place rotation with respect to the neck;

a nozzle head, in which a male screw part corresponding to the female screw part formed at the nozzle cap is formed, a nozzle is formed at a front end of a nozzle pipe formed extending a predetermined length toward the front, and a guide plate is formed protruding to be assembled to a guide rail formed at the neck capable of operating forward and backward with respect to the neck;

a valve body formed in a cylindrical shape, in which a liquid chemical supply hose is connected to a rear end and a check valve is installed therein, in which a plunger for selectively opening and closing the nozzle pipe is formed protruding in the front thereof;

a valve housing formed in a cylindrical structure fixedly installed at a rear of the nozzle head and forming a valve seat at an inner portion in which the valve body is stably installed; and a motor housing faced and assembled with the rear of the valve housing so that the rear thereof is maintained in a fixed state, in which the air blowing module is installed, wherein a flange surrounding a predetermined portion in the front of the motor housing is formed at a predetermined portion at the rear of the valve housing and an engaging hole corresponding to a locker protruding from the motor housing is formed in the flange.

2. The liquid chemical sprayer claim 1, wherein, in a state in which the locker is fitted to the engaging hole, the valve housing and the motor housing are rotated at a predetermined angle to each other to be integrally coupled.

3. The liquid chemical sprayer claim 1, wherein an engaging protrusion is formed to protrude at a predetermined interval on an outer circumferential surface of the valve body and a slot corresponding to the engaging protrusion is formed at a predetermined interval on the valve seat.

4. The liquid chemical sprayer claim 1, wherein the nozzle head is formed in a shape of six pinwheels so that ribs are formed at a predetermined angular interval and the nozzle pipe is located in a center, and the ribs are swirled in an air flowing from the rear toward the front.

5. The liquid chemical sprayer claim 1, wherein a hose pocket through which a liquid chemical supply hose is disposed is formed at one side of an inner portion of the motor housing.

6. The liquid chemical sprayer claim 1, wherein the plunger is formed in a cone shape with a rubber material, and is assembled at a front end of the valve body.

* * * * *